United States Patent [19]

Zijsling

[11] Patent Number: 4,844,180

[45] Date of Patent: Jul. 4, 1989

[54] DOWNHOLE DRILLING MOTOR

[75] Inventor: Djurre H. Zijsling, Assen, Netherlands

[73] Assignee: Shell Oil Company, Houston, Tex.

[21] Appl. No.: 158,951

[22] Filed: Feb. 22, 1988

[30] Foreign Application Priority Data

Apr. 21, 1987 [GB] United Kingdom ..... 8709380

[51] Int. Cl.[4] ..... E21B 4/02

[52] U.S. Cl. ..... 175/107; 175/61; 175/321; 267/125; 267/137; 464/18

[58] Field of Search ..... 175/107, 26, 27, 25, 175/38, 48, 92, 94, 321; 418/48; 464/18; 415/118, 502; 267/125, 137

[56] References Cited

U.S. PATENT DOCUMENTS

| | | | |
|---|---|---|---|
| 2,879,032 | 3/1959 | Whittle | 175/25 |
| 2,937,007 | 5/1960 | Whittle | 175/107 X |
| 2,942,851 | 6/1960 | Beck | 175/107 |
| 3,047,079 | 7/1962 | Wepsala, Jr. | 175/107 |
| 3,949,150 | 4/1976 | Mason et al. | 175/321 |
| 3,998,443 | 12/1976 | Webb | 267/125 |
| 4,067,405 | 1/1978 | Bassinger | 175/321 |
| 4,133,516 | 1/1979 | Jurgens | 267/125 |
| 4,171,025 | 10/1979 | Bassinger | 175/65 |
| 4,186,569 | 2/1979 | Aumann | 64/23 |
| 4,223,746 | 9/1980 | Tanguy et al. | 175/40 |
| 4,246,765 | 1/1981 | Zabeik | 64/23 |
| 4,260,030 | 4/1981 | Fox | 175/107 |
| 4,281,726 | 8/1981 | Garrett | 175/321 |
| 4,303,138 | 12/1981 | Bassinger | 175/296 |
| 4,331,006 | 5/1982 | Bishop | 464/18 |
| 4,387,885 | 6/1983 | Bishop et al. | 267/125 |
| 4,434,863 | 3/1984 | Garrett | 175/321 |
| 4,439,167 | 3/1984 | Bishop et al. | 464/20 |
| 4,465,147 | 8/1984 | Feenstra et al. | 175/73 |
| 4,485,879 | 12/1984 | Kamp et al. | 175/61 |
| 4,492,276 | 1/1985 | Kamp | 175/61 |
| 4,552,230 | 11/1985 | Anderson | 175/321 |
| 4,560,014 | 12/1985 | Geczy | 175/107 |
| 4,657,090 | 4/1987 | Geczy | 175/107 X |
| 4,660,656 | 4/1987 | Warren et al. | 175/26 |
| 4,721,172 | 1/1988 | Brett et al. | 175/107 X |

OTHER PUBLICATIONS

"'Hi-Temp' Steel Spring Shock Sub® Vibration Dampener," from the 1976–77 Composite Catalog® of Oil Field Equipment & Services, pp. 2158–2162, published by World Oil.

*Primary Examiner*—Stephen J. Novosad

[57] ABSTRACT

A downhole drilling motor is disclosed in which an output shaft is allowed to translate in axial direction relative to the motor housing over a predetermined stroke. Fluid pressure of a drilling fluid pumped to a rotary drill bit driven by the motor may be used during operation of the motor to exert a predetermined axial force to the output shaft so as to control the axial force exerted to the bit during drilling.

17 Claims, 2 Drawing Sheets

DOWNHOLE DRILLING MOTOR

BACKGROUND OF THE INVENTION

The invention relates to a downhole drilling motor for use in subsurface well drilling operations.

Downhole drilling motors generally comprise a motor housing which is connected at the lower end of an elongate drill string and an output shaft which drives a rotary drill bit. The motors are usually hydraulic motors that are driven by the flow of drilling fluid through the drill string.

During drilling operations the weight of the drilling assembly is commonly utilized to exert an axial force to the bit. The magnitude of said axial force may fluctuate during drilling due to friction between the drill string and borehole wall and due to drill string dynamics. Conventional downhole drilling motors have a tendency to stall if a fluctuating axial force is exerted to the bit since such fluctuations generate similar fluctuations in bit torque.

SUMMARY OF THE INVENTION

It is an object of the invention to provide a downhole drilling motor which is able to exert a substantially constant axial force to the bit during drilling.

The downhole drilling motor according to the present invention comprises a bearing unit which guides the output shaft in such a manner relative to the motor housing that the shaft is allowed to rotate about a central axis thereof and to translate in axial direction relative to the housing over a predetermined stroke. The motor further comprises means for exerting an axial force between the output shaft and motor housing.

In a preferred embodiment of the invention the motor is a hydraulic motor of the Moineau type. A Moineau motor is particularly attractive for incorporating the axially slidable shaft according to the invention because sealing of the rotor in the stator housing is guaranteed for any axial rotor position, which is inherent to the Moineau motor principle. Furthermore, the rotor of the motor may be utilized as a means for imposing an axial force to the output shaft since the pumpout force acting on the rotor already exerts an axial force to the output shaft driven by the rotor.

BRIEF DESCRIPTION OF THE DRAWINGS

The invention will now be explained in more detail with reference to the accompanying drawings, in which.

DETAILED DESCRIPTION OF THE PREFERRED EMBODIMENTS

Figure 1:
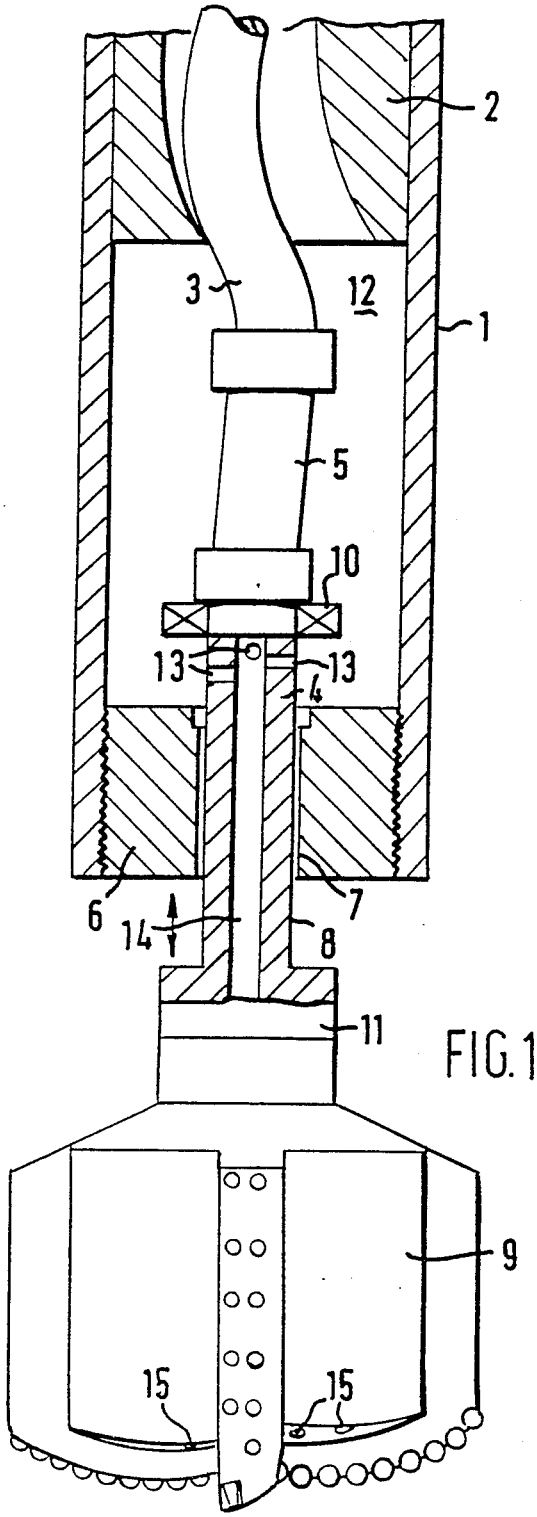
FIG. 1 illustrates a cross-sectional schematic view of the lower part of a downhole drilling motor according to the invention.

In FIG. 1 there is shown a downhole motor of the Moineau type. The motor comprises a motor housing 1 in which a rubber stator 2 is secured. The motor further comprises a helical rotor 3 which is connected to an output shaft 4 by a universal joint 5. The output shaft 4 is guided by a radial bearing 6 mounted at the lower end of the motor housing 1 such that the shaft 4 is allowed to rotate about a central axis thereof and to translate in axial direction relative to the housing 1.

The radial bearing 6 comprises a cylindrical inner surface 7 which surrounds part of the length of the cylindrical outer surface 8 of a tubular section of said shaft 4.

At the lower end of the output shaft 4 there is mounted a rotary drill bit 9. The output shaft 4 carries at the upper end thereof a thrust bearing 10. The upper end of a mounting sub 11 carrying the bit 9 and the thrust bearing 10 provide stops which limit the axial stroke over which the output shaft 4 is allowed to translate relative to the motor housing 1.

During operation of the motor, drilling fluid passing through the motor flows from a fluid outlet chamber 12 via a series of radial port openings 13 and a central passageway 14 in the hollow output shaft 4 toward jet nozzles 15 in the bit 9. The radial port openings 13 are located at different axial positions just below the thrust-bearing 10 so that when the output shaft 4 moves toward its lowermost position, the openings are gradually plugged by the inner surface 7 of the radial bearing 6.

The increased flow resistance caused by said plugging of the port openings 13 can be detected at the surface as an increased pump or standpipe pressure. In response to said increase of pressure, the drill string carrying the motor may be lowered over a distance corresponding to the stroke of the output shaft 4 so as to bring the output shaft 6 back into a retracted position thereof. Said step of lowering the string is repeated each time when an increased pumping pressure is monitored, thereby keeping the output shaft 4 continuously between the ends of its stroke.

During operation of the motor, the axial "pumpout" force acting on the rotor 3, which force is proportional to the pressure difference across the motor (which is proportional to the torque provided by the motor), is transferred via the universal joint 5 to the output shaft 4. A second contribution to the pumpout force acting on the output shaft results from the pressure difference across the bit nozzles 15. Thus the axial force or "Weight-on-Bit" (WOB) exerted through the output shaft 4 to the bit 9 is proportional to the torque provided by the motor and to the pressure drop across the nozzles 15 of the bit, which pressure drop is proportional to the mud circulation rate squared.

Figure 2:
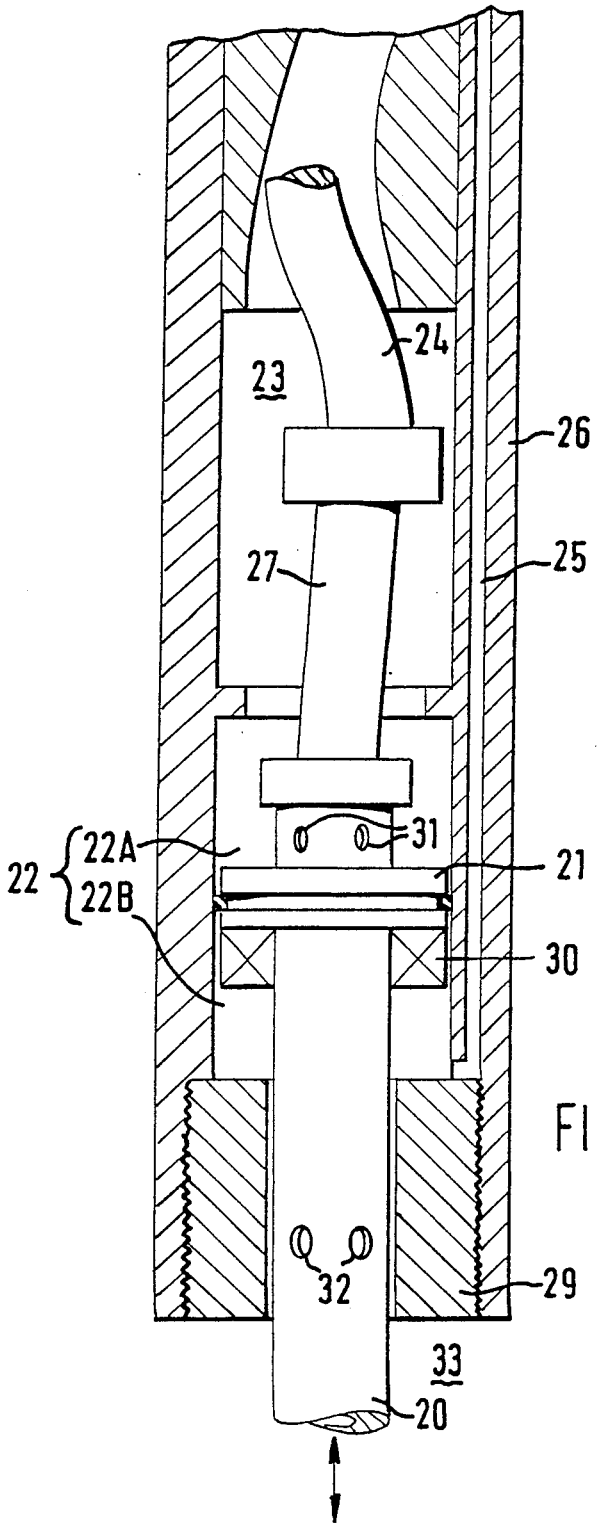
FIG. 2 illustrates a cross-sectional schematic view of the lower part of another drilling motor embodying the invention.

If necessary, the axial force exerted to the drill bit 9 during operation of the motor may further be controlled by arranging an axial spring or springs between the thrust bearing 10 and the motor housing 1, or by providing the output shaft with a hydraulic plunger as illustrated in FIG. 2.

FIG. 2 shows the lower part of a Moineau drilling motor provided with an axially slidable output shaft 20 which carries a hydraulic plunger 21.

The plunger 21 divides a tubular section 22 of the interior of the housing into an upper section 22A and a lower section 22B. The upper section 22A is in fluid communication with a fluid outlet chamber 23 located downstream of the rotor 24. The lower section 22B is in fluid communication with the interior of the drill string (not shown) above the motor via a bypass opening 25 in the motor housing 26. Thus, during operation of the motor, the plunger 21 exerts an upward axial force to the output shaft 20 which is proportional to the pressure difference across the motor and to the size of the plunger 21. The upward axial force exerted by the plunger 21 to the shaft 20 at least partly counteracts the downwardly directed pumpout force exerted by the rotor 24 to the output shaft 20 via the universal joint 27.

By adequately sizing the plunger 21 in relation to the size and shape of the rotor 24, a total axial force may be exerted to the output shaft 20 which force is lower than the pumpout force exerted to the rotor 24.

If, on the other hand, the pumpout force exerted to the rotor 24 is considered too low for a proper operation of the bit driven by the motor, the lower housing section 22B may be connected in fluid communication with the exterior of the motor via a radial opening in the housing wall instead of with the fluid inlet of the motor. The piston in that case will exert a downward axial force to the output shaft 20 which accumulates with the pumpout force acting on the rotor 24. In the above manner the torque-weight on bit (WOB) characteristics of the motor can be matched to the optimum torque-weight on bit (WOB) combination for the bit so that optimum operating conditions can be maintained during drilling.

The output shaft 20 of the motor shown in FIG. 2 is guided relative to the motor housing 26 by a radial bearing 29 and by a thrust bearing 30. The thrust bearing 30 rests upon the radial bearing 29 if the output shaft 20 has reached the lower end of its stroke. The hollow output shaft 20 comprises a series of radial fluid inlet ports 31 which are located above the plunger 21 and a series of radial fluid outlet ports 32 which are sealed off by the internal surface of the radial bearing 29 if the output shaft 20 is located above the upper end of its stroke, but which are in communication with the exterior 33 of the motor if the output shaft 20 has reached the lower end of its stroke.

The decreased flow resistance caused by said opening of the fluid outlet ports 32 can be detected at the surface by monitoring the pump or standpipe pressure. If a reduced standpipe pressure is monitored at the surface, then the drill string is lowered somewhat so as to push the output shaft 20 back into a contracted position. If, after drilling of a borehole section of a length equal to the stroke of the output shaft, the monitored standpipe pressure decreases again, the drillpipe is again lowered somewhat. This procedure is repeated throughout the drilling operations as necessary.

It will be understood that a Moineau motor is particularly suitable for incorporating the present invention since sealing between the rotor and stator is guaranteed for any axial position of the rotor relative to the stator and since there is no other bearing other than the bearing of the output shaft. Thus, the rotor of the motor can move together with the output shaft in axial direction through the motor housing and the pumpout force exerted by the drilling fluid to the rotor can be utilized to exert a desired axial force to the bit during drilling.

It will further be understood that other drilling motors may incorporate the invention as well. Such other motors may, for example, be hydraulic motors such as turbine or vane motors, or electric motors. Since in such other motors it is in general not possible to allow the rotor to slide in axial direction relative to the stator, such motors would require the arrangement of a spline connection between the rotor and output shaft, which connection allows the output shaft to slide in axial direction relative to the rotor.

The motor concept according to the invention enables proper matching of the torque-weight on bit (WOB) output of the motor to the optimum torque-weight on bit (WOB) combination of a bit driven by the motor. Furthermore weight on bit (WOB) fluctuations resulting from drill string dynamics are eliminated. The stalling tendency of the motor during drilling is eliminated in this manner and optimum operating conditions are created for drilling with highly agressive bits, such as self-advancing bits, which enables a light-weight bottom hole drilling assembly to be used.

Utilization of the motor concept according to the invention in the steerable drilling motor disclosed in U.S. Pat. No. 4,492,276 will considerably improve the toolface stability during oriented drilling of long highly inclined or even horizontal borehole sections with the steerable drilling motor.

Various other modifications and utilizations of the motor concept according to the invention will become apparent to those skilled in the art from the foregoing description and accompanying drawing. Such modifications and utilizations are intended to fall within the scope of the appended claims.

What is claimed is:

1. A downhole drilling motor, comprising:

a housing having an interior tubular part;

an output shaft;

a bearing unit for guiding the output shaft relative to the housing in such a manner that the shaft is allowed to rotate about a central axis thereof and to translate in axial direction relative to the housing over a predetermined stroke; and a shock-absorbing means for exerting an axial force between the output shaft and the housing comprising a plunger mounted on the output shaft which divides the tubular part of the housing with an upper section and a lower section.

2. The motor of claim 1, wherein the output shaft protrudes from a lower end of the housing and the bearing unit comprises a low friction bearing which is mounted near said lower end of the housing and surrounds part of the length of a tubular section of said shaft.

3. The motor of claim 2, wherein the shaft is provided with a stop means mounted at the upper and lower ends of said tubular section.

4. The motor of claim 3, wherein the stop means at the lower end of said shaft is provided by a mounting sub of a rotary drill bit carried by the shaft.

5. The motor of claim 3, wherein the stop means at the upper end of said shaft is provided by a thrust bearing carried by the shaft.

6. The motor of claim 3, wherein the motor is a hydraulic motor of the Moineau type, and such means for exerting an axial force between the output shaft and motor housing further comprises a rotor.

7. The motor of claim 6, wherein the stop means at the upper end of said shaft is provided by a thrust bearing carried by the shaft and wherein said means for exerting an axial force between the shaft and motor housing further places the plunger mounted on said shaft above said thrust bearing.

8. The motor of claim 7, wherein said lower section of said tubular part is in fluid communication with a fluid inlet of the motor and said upper section of said tubular part is in fluid communication with a fluid outlet of the motor.

9. The motor of claim 8, wherein said output shaft comprises an axial fluid passageway which is at the upper end thereof connected in fluid communication with said fluid outlet of the motor via radial ports in the wall of a portion of said output shaft located above said plunger.

10. The motor of claim 9, wherein said tubular section of the output shaft comprises radial fluid outlet ports which are sealed off by the radial bearing if the output shaft is located above the lower end of its stroke but which provide a fluid communication between said fluid passageway and the exterior of the housing if the output shaft is located at the lower end of its stroke.

11. A downhole Moineau type hydraulic drilling motor, comprising:

a housing having an interior tubular part;

an output shaft having a tubular section and protruding from the lower end of the housing;

a bearing unit for guiding the output shaft relative to the housing in such a manner that the shaft is allowed to rotate about a central axis thereof and to translate in axial direction relative to the housing over a predetermined stroke, said bearing unit comprising a low friction bearing mounted near said lower end of the housing and surrounding part of the length of the tubular section of said output shaft;

a stop means mounted on the output shaft at the upper and lower ends of said tubular section; and means for exerting an axial force between the output shaft and the housing, comprising:

a rotor operably connected to the output shaft; and a plunger mounted on said output shaft above said stop means, which plunger divides a tubular part of the interior of the housing located below the rotor into an upper section and a lower section.

12. A downhole drilling motor in accordance with claim 11 wherein the stop means at the lower end of said output shaft comprises a mounting sub of a rotary drill bit carried by the output shaft.

13. A downhole drilling motor in accordance with claim 11, wherein the stop means at the upper end of said output shaft comprises a thrust bearing carried by the output shaft.

14. A downhole drilling motor in accordance with claim 11, wherein said lower section of said tubular part is in fluid communication with a fluid inlet of the motor and said upper section of said tubular part is in fluid communication with a fluid outlet of the motor.

15. A downhole drilling motor in accordance with claim 14, wherein said output shaft comprises an axial fluid passageway which is at the upper end thereof connected in fluid communication with said fluid outlet of the motor via radial ports in the wall of a portion of said output shaft located above said plunger.

16. A downhole drilling motor in accordance with claim 15, wherein said tubular section of the output shaft comprises radial fluid outlet ports which are sealed off by the radial bearing when the output shaft is located above the lower end of its stroke, but which provide a fluid communication between said fluid passageway and the exterior of the housing when the output shaft is located at the lower end of its stroke.

17. A downhole Moineau type drilling motor comprising:

a housing having an interior tubular part;

an output shaft protruding from a lower end of the housing and having a length of a tubular section;

a bearing unit for guiding the output shaft relative to the housing in such a manner that the shaft is allowed to rotate about a central axis thereof and to translate in axial direction relative to the housing over a predetermined stroke; said bearing unit comprising a low-friction bearing which is mounted near said lower end of the housing and which surrounds part of the length of the tubular section of the shaft;

a thrust bearing carried on the output shaft at the upper end of the tubular section to provide a stop means;

means for exerting an axial force between the output shaft and the housing, said means for exerting an axial force comprising:

a rotor in the housing above the tubular part thereof and connected to the output shaft; and a plunger below the rotor dividing the interior tubular part of the housing into an upper section and a lower section.

* * * * *